US008109446B2

(12) United States Patent
Venancio

(10) Patent No.: US 8,109,446 B2
(45) Date of Patent: Feb. 7, 2012

(54) METHOD OF CONTROLLING A CELL THAT IS USED FOR THE RAPID COOLING OF A COOKED PRODUCT IN ORDER TO PRESERVE SAME

(75) Inventor: Rafael Venancio, Sens (FR)

(73) Assignee: Friginox, Villevallier (FR)

( * ) Notice: Subject to any disclaimer, the term of this patent is extended or adjusted under 35 U.S.C. 154(b) by 797 days.

(21) Appl. No.: 12/089,256

(22) PCT Filed: Oct. 5, 2006

(86) PCT No.: PCT/FR2006/002242

§ 371 (c)(1),
(2), (4) Date: Jul. 28, 2008

(87) PCT Pub. No.: WO2007/039685

PCT Pub. Date: Apr. 12, 2007

(65) Prior Publication Data

US 2009/0222146 A1 Sep. 3, 2009

(30) Foreign Application Priority Data

Oct. 5, 2005 (FR) ..... 05 10183

(51) Int. Cl.
*G05D 23/20* (2006.01)

(52) U.S. Cl. ..... 236/46 C; 62/157

(58) Field of Classification Search ..... 62/157, 62/231, 62; 165/267, 268; 236/46 C
See application file for complete search history.

(56) References Cited

U.S. PATENT DOCUMENTS 4,697,429 A * 10/1987 Chandler et al. ..... 62/203
7,810,338 B2 * 10/2010 Marx et al. ..... 62/62

FOREIGN PATENT DOCUMENTS

| | | |
|---|---|---|
| FR | 2 849 579 | 7/2004 |
| JP | 05 010643 | 1/1993 |
| JP | 06 341747 | 12/1994 |
| JP | 06341747 A * | 12/1994 |
| JP | 2000 121223 | 4/2000 |
| JP | 2000 249447 | 9/2000 |
| JP | 2001 082853 | 3/2001 |

* cited by examiner

*Primary Examiner* — Cheryl J Tyler
*Assistant Examiner* — Jonathan Bradford
(74) *Attorney, Agent, or Firm* — Trego, Hines & Ladenheim, PLLC

(57) ABSTRACT

The invention relates to a method of controlling a cell that is used for the rapid cooling of a cooked product. The method includes the steps of taking a period measurement of an internal temperature of the product to be cooled and of the temperature of the ambient air in a chamber; and using the temperature measurements to determine a set value for the temperature of the ambient air inside the chamber. The set temperature value for the ambient air in the chamber is used to control the cold production element until the end of the cooling cycle in order to obtain an internal temperature at the end of the cycle that is less than a pre-determined end internal temperature using a cycle length of less than or equal to a pre-determined maximum cycle length. The invention is suitable for commercial and institutional catering and for the agri-food industry.

14 Claims, 1 Drawing Sheet

*1* - 13 kg automatic pilot

2 – 13 kg auto-adaptive pilot 110 min

[left vertical:] air temperature °C

SINGLE FIGURE
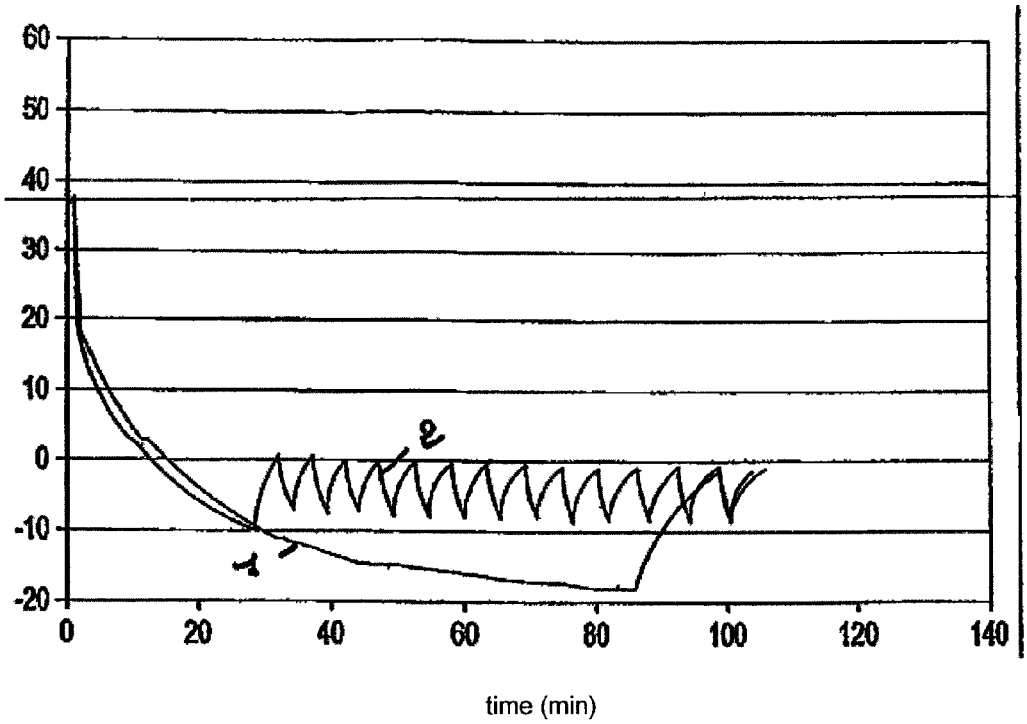
*1* - 13 kg automatic pilot
*2* – 13 kg auto-adaptive pilot 110 min
[left vertical:] air temperature °C

METHOD OF CONTROLLING A CELL THAT IS USED FOR THE RAPID COOLING OF A COOKED PRODUCT IN ORDER TO PRESERVE SAME

The present invention concerns a method of control of the quick cooling of a quick cooling cell designed to be used in commercial and institutional catering and in the agri-food industry as well as a device for its application.

In commercial or institutional catering, it is useful to be able to prepare dishes in advance and then cool them quickly in order to store them for subsequent use from a few hours to several days later by simple reheating. Preparation times can thus be better managed. However, in the preparation of food products, it is indispensable to observe all the health regulations, so that the products obtained will have all the qualities required for sale without danger.

Thus, the objective of quick cooling is to prevent food products from remaining too long a time after cooking at a temperature conducive to multiplication of the micro-organisms responsible for food poisoning. In particular, regulations, recommendations or codes of good practices specify the duration not to be exceeded between an initial core temperature and a core temperature on arrival. Thus, the French regulations of 1997 stipulated a maximum duration of 2 hours between +63° C. and +10° C. internally, while in the USA, reference is made to a maximum duration of 4 hours between +60° C. and +4° C.

This quick cooling is generally carried out in quick cooling cells consisting of refrigerating equipment specially designed to cool hot foods quickly, immediately after cooking. Quick freezing cells are also known, which consist of refrigerating equipment specially designed to freeze hot foods quickly immediately after cooling. The quick freezing cells can also function as quick cooling cells.

The quick cooling/freezing cells consist mainly of an isothermal chamber, a powerful internal air circulation device, a cold production unit with its heat exchanger placed inside the isothermal chamber and a control device, usually of electronic type, managing the assembly.

However, the quick cooling method is constrained by two conflicting objectives. The first is quantitative and consists of cooling the food product between two core temperature values within a maximum time for the purpose of food safety. This may necessitate producing low air temperature well below 0° C.

The second is qualitative and consists of avoiding surface freezing of the food product to be cooled in order to avoid a dangerous change of structure altering its quality. This entails preventing an air temperature too low and/or for too long a time. A risk of the product's surface freezing exists as soon as the temperature of the air on the product falls below −2° C.

Consequently, to accomplish the objective of food safety, a low air temperature is necessary on the use of a cell at its nominal capacity, or when short cooling times are required, or in order to reach a final core temperature close to 0° C., or for very thick products or for products with a wrapping unfavorable for heat exchange. But in daily use, it usually serves no purpose to produce a low air temperature to accomplish such objective. This is thus the case on loading a small quantity of product in the apparatus, or on loading an easily cooled product, or in order to reach a final core temperature much higher than 0° C., or when a long cooling time is admissible. The cell is then in a situation of excess power. The consequence is a very rapid drop in air temperature, much more rapid than that of the core temperature. In the end, the product is cooled in a much shorter time that the maximum duration required, but it is partially frozen on the surface.

The cold production equipment can also lead to a situation of excess power, producing the same effects as underloading of the apparatus. This is because the power of the cold production equipment exceeds that necessary to cool the apparatus at nominal capacity after a voluntary choice or poor evaluation of the characteristics of the installation or even after a variation of power of the cold production equipment between summer and winter. Equipment selected for an exceptionally hot summer will be much more powerful in wintertime because of the low outdoor temperatures.

This phenomenon of surface freezing of products is one of the major problems of quick cooling cells.

At the present time, it is customary to use one more probes inserted in the food product throughout the quick cooling phase. Such probes continuously measure the core temperature of the product and determine the arrival at the desired final core temperature. Once the final core temperature is reached, the control device switches the apparatus to a position maintaining a positive temperature (above 0° C.) or turns off the apparatus. The direct measurement of the core temperature of the product makes it possible to interrupt the quick cooling phase at the right time, regardless of the characteristics of the product or of the apparatus. However, such probes alone make it possible to master the objective of food safety. Still today, a number of quick cooling/freezing cell manufacturers are satisfied with that objective.

Also, in addition to the probes, control devices have been developed for a number of years to reduce the risk of surface freezing. These control devices possess programmed functions making possible:

- a limitation of air temperature throughout the cooling time, the air temperature being unable to drop below a given value, a switch also being possible between several air temperature limitations in the course of cooling, based on crossing one or more thresholds on air temperature and/or on core temperature and/or on time elapsed from the start of cooling;
- a reduction of air circulation inside the apparatus, that reduction of air circulation being permanent throughout the cooling or activatable during its progress, according to the same principle as the air temperature limitation.

The applicant, the Friginox company, was the first to develop in 1987 a system making it possible to reduce the risk of surface freezing of the product by using a multipoint probe, making it possible to measure the temperature of the product at different depths. An air temperature limitation at a negative temperature is active from the start of the quick cooling cycle. When the core temperature reaches a pre-determined value, the air temperature limitation is changed to a value of 0° C. Other manufacturers have since adopted that principle or similar principles.

This probe and control device assembly are commonly described as an automatic pilot device.

However, a single air temperature limitation value and/or a reduction of air circulation and/or thresholds making it possible to switch them cannot be suitable because of the large number of parameters influencing quick cooling (characteristics of the food product, wrapping, maximum duration of core temperature between the beginning and end of cooling, core temperature of the product at end of cooling, temperature of the flow of air on the product, rate of air flow on the product, etc.). New values or new thresholds must, therefore, be determined by experimentation for each different situation. This represents an infinite number of combinations and considerable loss of time on passage from one type of product to another.

In order to get around this difficulty, three solutions have been recommended. The first solution consists of proposing a fixed value. Standard values memorized, in the control device are thus used. The limitation values of air temperature, air circulation reduction and switching thresholds are determined by prior experimentation. The different values can often be modified, but with difficulty for a daily user of the apparatus. This is necessarily a compromise which promotes the objective of food safety, but raises the risk of surface freezing of the product. Consequently, obtaining the qualitative objective, namely, avoiding freezing of the surface of the product, often fails.

Another proposed solution is a key that limits air temperature close to 0° C. or reduces air circulation. The user then selects on the control panel, by pressing a key, an operation of the apparatus with limitation of air temperature close to 0° C. or a reduction of air circulation. Consequently, the user must assess the weight of the food product and the thermal behavior of the food product, the wrapping and the cooling cell in order to make a decision. If that air temperature limitation close to 0° C. or a low air circulation is selected when a hard-to-cool product is in the apparatus, the duration of cooling is going to exceed the maximum time required. The food safety objective of quick cooling can then fail.

The last solution consists of having the user select on the control panel, by pressing keys, one program (among a set of programs) in which one or more sequences of air temperature limitation and/or air circulation reduction values and their switching thresholds are memorized. Consequently, the decision is again left up to the user who must assess the weight of the food product and the thermal behavior of the food product, of the wrapping and of the cooling cell. A poor evaluation by the user will lead either to surface freezing of the product or to a cooling time exceeding the maximum duration required. That solution can then result either in failure of the food safety objective or in failure of the qualitative objective.

None of these control devices makes it possible to solve correctly the risk of freezing of the product, for they are all based on the human estimation of extremely complex phenomena.

The present invention is, therefore, intending to propose a method of control of the means of cooling a quick cooling cell making possible a cooling time less than or equal to the maximum duration required, with the lowest possible cold air temperature inside the container, without any action or decision on the part of the user, regardless of the product, its structure, the product weight in the apparatus, the thickness of the product, the wrapping of the product, the capacity of the apparatus, etc. The present invention, by comparison with all the present control devices, therefore, ensures the quality of the product (no surface freezing of the product) and corrects what is not accomplished by the so-called automatic pilot device.

For this purpose, the object of the invention is a method of control of a quick cooling cell for a cooked product for the purpose of preserving it, consisting mainly of an isothermal chamber, an internal air circulation device, a cold production unit with its heat exchanger generally placed inside the isothermal chamber and at least one probe insertable in the core of the product, characterized in that a periodic reading is made of the core temperature of the product to be cooled and of the ambient air temperature in the container, and in that after said temperature measurements, a set value of the ambient air temperature is determined inside the container, regardless of the type of product, its structure, the product weight in the apparatus, the thickness of the product and the wrapping of the product, as well as the capacity of the apparatus, that set value of ambient air temperature inside the container serving to control the cold production equipment until the end of the cooling cycle, in order to attain a core temperature at the end of the cycle below a final core temperature predetermined according to a cycle time less than or equal to a predetermined maximum cycle time.

The method of control according to the invention thus advantageously makes it possible to determine a set value of air temperature inside the container enabling mastery of the conditions of quick cooling of the product in the predetermined maximum time by reducing to a minimum the risk of surface freezing of the product, regardless of the product, the wrapping of the product, the product weight in the cooling cell, the capacity of the cell and the actual filling of the cell.

The method of control according to the invention, therefore, makes possible auto-adaptive cooling of the product to be cooled automatically, regardless of the product, the wrapping of the product, the product weight in the cooling cell, the capacity of the cell and the actual filling of the cell, that is, independent of the type of product, the wrapping of the product, the product weight in the cooling cell, the capacity of the cell and the actual filling of the cell.

The set value of the ambient air temperature inside the container is also preferably as close as possible to 0° C.

In particular, the method of control according to the invention advantageously makes the operation of cooling cells possible even at low capacity.

As the set value of air temperature can also be invoked, the limitation of air temperature in the container is auto-adapted to the method of the invention, regardless of the type of product, wrapping, total weight of product in the cell and variation of refrigerating capacity between summer and winter. That set value of air temperature corresponds to the temperature at which the refrigerating compressor of the cooling means, for example, stops and starts.

Advantageously, after each measurement of air temperature and core temperature, said measured values are treated so as to determine:

the deviation between the core temperature measured and the air temperature measured in the container, the calculated (predicted) time of arrival at the predetermined core temperature from core temperatures measured as a function of time, a mean value of the calculated time of arrival at the predetermined final core temperature;

the slope of variation of the calculated time of arrival at the predetermined final core temperature, and the deviation between the core temperature and the air temperature at the maximum time of arrival calculated, on the basis of the deviation between the core temperature measured and the air temperature measured in the container as a function of time.

Optionally, it is also possible to determine the slope of variation of the air temperature measured in the container and the stability of said slope.

These instantaneous temperature measurements as well as these values determined from processing of the temperature measurements carried out advantageously make it possible to establish values usable in the process of determination of the set value of the air temperature in the container.

The periodic reading of temperatures is preferably carried out every minute.

Advantageously, before the start of the cooling cycle one predetermines an initial core temperature value of the product to be cooled and a final core temperature value of said product predetermined, as well as a maximum cycle time in order to pass from one of those temperatures to the other and, therefore, a maximum arrival time calculated in order to reach the predetermined final core temperature.

The method of control according to the invention presents, from the start of the cooling cycle, the following stages of determination of the set value of the ambient air temperature on each reading of the core temperatures and air temperatures in the container.

First of all, the measured air temperature value Ta is compared with an air temperature reference value Tar. As long as the measured air temperature Ta is higher than that temperature reference value Tar, the comparison between the measured air temperature and the air temperature reference value is repeated on each new temperature reading. The ambient air reference value Tar is preferably 0° C.

When the measured air temperature Ta is less than the air temperature reference value Tar, we pass to the following stage, which consists of comparing the calculated time of arrival at the predetermined finale core temperature with the calculated maximum time of arrival. As long as the calculated time of arrival at the predetermined final core temperature exceeds the calculated maximum time of arrival, the comparison is repeated on each new temperature reading until the calculated time of arrival at the predetermined final core temperature falls below the calculated maximum time of arrival.

As soon as that comparison is validated, the slope of variation of the calculated time of arrival at the predetermined final core temperature is compared to a predefined threshold value.

However, if the calculated time of arrival at the predetermined final core temperature is far behind the calculated maximum time of arrival, the set value of the air temperature at determined at 0° C. and the cycle is continued at that set value until the core temperature of the product is below the predetermined final core temperature.

If the slope of variation of the calculated time of arrival at the predetermined final core temperature is not greater than the predefined threshold value, it then follows that the slope is too steep and, in that case, the calculated time of arrival at the pre-determined final core temperature will be much shorter than the calculated maximum time of arrival, which makes it possible to fix as of now the set value of the air temperature at 0° C. and thus continue the cycle at that set value until the core temperature of the product is below the predetermined final core temperature.

If, on comparison, it turns out that the slope of variation of the calculated time of arrival at the predetermined final core temperature is greater than the predefined threshold value and that the measured air temperature is less than a fixed predetermined value well below 0° C., such as −20° C., for example, the set value of the air temperature is determined at said fixed predetermined value (−20° C.) and then the set value of the air temperature is determined at 0° C., when the measured core temperature reaches a fixed predetermined value, such as, for example, 15° C.

However, if, on comparison, it turns out that the slope of variation of the calculated time of arrival at the predetermined final core temperature is greater than the predefined threshold value, the calculated time of arrival at the predetermined final core temperature is then compared to the mean value of the calculated time of arrival at the predetermined final core temperature plus or minus a tolerance value of stabilization of the calculated time of arrival at the predetermined final core temperature, that tolerance value being predefined.

As long as the calculated time of arrival at the predetermined final core temperature does not exceed the mean value of the calculated time of arrival at the pre-determined final core temperature less the stabilization tolerance value and falls below the mean value of the calculated time of arrival at the predetermined final core temperature plus the stabilization tolerance value, the comparison is resumed on each new temperature reading.

After each measurement of air temperature and core temperature, said measured values can be treated so as to determine also by option the slope of variation of the air temperature measured in the container and the stability of said slope, and once the stability of the slope of variation of the calculated time of arrival at the pre-determined core temperature is established, it can be determined that the slope of variation of the air temperature measured regularly decreases. Until that stability of the slope of air temperatures in the container is reached, this stage can be repeated.

The air temperature in the container is then determined when the predetermined final core temperature is reached as being the predetermined final core temperature less the predicted deviation between the core temperature and the air temperature at the maximum calculated time of arrival.

That air temperature in the container is then compared when the predetermined final core temperature is reached with the air temperature measured in the container. If said temperature does not exceed or equals the air temperature measured in the container, the stages are resumed from that of determination of the stability of the slope of variation of ambient air temperature for each new reading of air and core temperatures.

If the air temperature in the container, when the predetermined final core temperature is reached, is found equal to or higher than that of the air measured in the container, it constitutes the set value of the air temperature in the container serving as a basis for control of the cooling means for continuation of the cooling cycle until the core temperature measured falls below the predetermined final core temperature.

If the set value of the air temperature serving as a basis for control of the cooling means for continuation of the cooling cycle is calculated at higher than 0° C., said set value is considered equal to 0° C. That set value can never be higher than 0° C.

According to a variant of the method of the invention, it is also possible at the start of the cycle to readjust the maximum duration of cooling as a function of the real temperature of the product on loading in the cell.

Thus, at the start of the cooling cycle, on the first temperature reading, the maximum duration of the predefined cycle is initialized at zero. The core temperature measured is then compared with the initial core temperature of the predefined cycle.

If the core temperature measured is higher than or equal to the initial core temperature of the predefined cycle, then the maximum duration of the cycle is equal to the duration of the predefined cycle.

If the core temperature measured does not exceed or equals the initial core temperature of the predefined cycle, then the maximum cycle time is defined as being the ratio of the product of the predefined cycle time with the core temperature measured less the final core temperature of the predefined cycle to the initial core temperature of the cycle time less the final core temperature of the predefined cycle.

It can, therefore, be considered that the method of control of the cooling means leads to an "analysis" of the product to be cooled.

The present invention also concerns a device for control of quick cooling cells for a cooked product for the purpose of preserving it, consisting mainly of an isothermal chamber, an internal air circulation device, a cold production unit with its heat exchanger placed inside the isothermal chamber and at least one probe insertable in the core of the product, characterized in that it contains means for periodic measurement of the core temperature and of the air temperature in the container, means of memorization of said temperature measurement, and means of treatment of the temperature measurements making it possible to determine a set value of the air temperature in the container, that set value of the air temperature in the container serving to automatically control the cold production equipment until the end of the cooling cycle in order to reach a core temperature at the end of the cycle below a final core temperature predetermined according to a cycle time less than or equal to a predetermined maximum cycle time.

The means of treatment of the temperatures read preferably comprise means of calculation making it possible to determine from the measurements read the deviation between the measured core temperature and the measured air temperature of the container, the calculated (predicted) time of arrival at the predetermined final core temperature, based on the core temperatures measured as a function of time, a mean value of the calculated time of arrival at the predetermined final core temperature, the slope of the variation of the time of arrival at the predetermined final core temperature, and the deviation between the core temperature and the air temperature at the maximum time of arrival calculated, on the basis of the deviation between the measured core temperature and the measured air temperature of the container as a function of time.

The means of treatment of the temperatures read optionally comprise means of calculation making it possible to determine from the measurements read the slope if variation of air temperature and the stability of said slope.

The means of treatment further contain means of comparison of said temperatures read, of said calculations made from said temperatures read and of predefined values. The means of calculation can advantageously embrace mathematical regressions. An exponential regression of the core temperature measured as a function of time can thus be used, for example, to determine the calculated time of arrival at the predetermined final core temperature, and a linear regression of the deviation between the core temperature measured and the air temperature measured in the container as a function of time in order to determine the deviation between the core temperature and the air temperature at the maximum time of arrival calculated.

The invention, therefore, also concerns a quick cooling cell for cooked products to be preserved, consisting mainly of an isothermal chamber, an internal air circulation device, a cold production unit with its heat exchanger placed inside the isothermal chamber and one or more probes insertable in the core of the product, containing proper means of applying the method according to the invention.

The invention likewise concerns a corresponding computer product, that is, the product which can be directly loaded in the memory of a computer and which comprises software parts making it possible to apply the method according to the invention, when the product is designed to operate on a computer, notably forming part of the control device of the cooling cell.

The invention will now be described more in detail with reference to a drawing in which the single FIGURE represents a diagram of the course of the ambient air temperature in a cooling cell managed according to the method of control of the present invention called auto-adaptive piloting and in a cell managed by the control device commonly described as an automatic pilot device.

The cooling cell represented in the example operates at low capacity, that is, the loading of the cell represents ¼ of the nominal load, which is 13 kg here.

As shown, the maximum cycle time for carrying out quick cooling is set at 110 min. It can be seen that the cooling time on automatic control is 86 minutes and the ambient air temperature is allowed to drop to −18° C. (curve 1).

The control method according to the invention makes it possible to determine a set value of ambient air temperature at −5° C. approximately 30 min. after starting the cooling cell and that value is respected by automatic regulation of the compressor until the end of the cooling cycle, which is 91 min. here (curve 2).

The invention claimed is:

1. Method of control of a quick cooling cell for a cooked product for the purpose of preserving the cooked product, comprising an isothermal chamber, an internal air circulation device, a cold production unit having a heat exchanger generally placed inside the isothermal chamber and at least one probe insertable in the core of the product, characterized in that a periodic reading is made of the core temperature of the product to be cooled and of the ambient air temperature in the chamber, and in that after said temperature measurements a set value of the ambient air temperature is determined inside the chamber, regardless of the type of product, its structure, the weight of the product in the apparatus, the thickness of the product and the wrapping of the product, as well as the capacity of the apparatus, that set value of ambient air temperature inside the chamber serving to control the cold production equipment until the end of the cooling cycle, in order to attain a core temperature at the end of the cycle below a final core temperature predetermined according to a cycle time less than or equal to a predetermined maximum cycle time, the set value of the ambient air temperature inside the chamber is as close as possible to 0° C., and in that after each measurement of air temperature and core temperature, said measured values are treated so as to determine:

- the deviation between the core temperature measured and the air temperature measured in the chamber,
- the calculated (predicted) time of arrival at the predetermined core temperature from core temperatures measured as a function of time,
- a mean value of the calculated time of arrival at the predetermined final core temperature,
- the slope of variation of the calculated time of arrival at the predetermined final core temperature, and
- the deviation between the core temperature and the air temperature at the maximum time of arrival calculated on the basis of the deviation between the core temperature measured and the air temperature measured in the chamber as a function of time.

2. Method according to claim 1, characterized in that, after each measurement of air temperature and core temperature, said measured values can be treated so as to determine also the slope of variation of air temperature measured in the chamber and the stability of said slope.

3. Method according to claim 2, characterized in that, before the start of the cooling cycle one predetermines an initial core temperature value of the product to be cooled and a final core temperature value of said product as well as a maximum cycle time, in order to pass from one of those temperatures to the other, and thus the maximum time of arrival of the core temperature at the predetermined final core temperature.

4. Method according to claim 3, characterized in that on each air temperature measurement, the said measured air temperature (Ta) is compared with a predefined reference value (Tar), until the measured air temperature (Ta) falls below the reference value (Tar).

5. Method according to claim 4, characterized in that once the measured air temperature (Ta) falls below the reference value of the air (Tar), a calculated time of arrival at the predetermined final core temperature is compared to the calculated maximum time of arrival.

6. Method according to claim 5, characterized in that, if the calculated time of arrival at the predetermined final core temperature is well below the maximum time of arrival calculated, the set value of the air temperature is determined at 0° C. and the cycle is continued at that set value until the core temperature of the product falls below the predetermined final core temperature.

7. Method according to claim 5, characterized in that, as soon as the calculated time of arrival at the predetermined final core temperature is under the calculated maximum time of arrival, the slope of variation of the calculated time of arrival at the pre-determined final core temperature is compared to a predefined threshold value.

8. Method according to claim 7, characterized in that, when the slope of variation of the calculated time of arrival at the predetermined final core temperature is not greater than the predefined threshold value, the set value of the air temperature is determined at 0° C. and the cycle is continued at that set value until the core temperature of the product falls below the predetermined final core temperature.

9. Method according to claim 7, characterized in that, when the slope of variation of the calculated time of arrival at the predetermined final core temperature is greater than the predefined threshold value and the measured air temperature is less than a fixed predetermined value well below 0° C., the set value of the air temperature is determined at said fixed predetermined value, and then the set value of the air temperature is determined at 0° C., when the core temperature measured reaches a fixed pre-determined value.

10. Method according to claim 7, characterized in that, when the slope of variation of the calculated time of arrival at the predetermined final core temperature is greater than the predefined threshold value, the calculated time of arrival at the predetermined final core temperature is then compared to the mean value of the calculated time of arrival at the predetermined final core temperature plus or minus a tolerance value of stabilization of the calculated time of arrival at the predetermined final core temperature, said tolerance value being predefined.

11. Method according to claim 10, characterized in that, after each measurement of air temperature and core temperature, said measured values can be treated so as to determine also the slope of variation of the air temperature measured in the chamber and the stability of said slope, and in that once the stability of the slope of variation of the calculated time of arrival at the predetermined core temperature is established, it can be determined that the slope of variation of the air temperature measured regularly decreases.

12. Method according to claim 11, characterized in that the air temperature in the chamber is determined, when the predetermined final core temperature is reached, as being the predetermined final core temperature less the predicted deviation between the core temperature and the air temperature at the maximum calculated time of arrival, that air temperature in the chamber is compared with the air temperature measured in the chamber, when the predetermine final core temperature is reached, and when the predetermined final core temperature equals or exceeds the air temperature measured in the chamber, it constitutes the set value of the air temperature in the chamber serving as a basis for control of the cooling means for continuation of the cooling cycle until the core temperature measured falls below the predetermined final core temperature.

13. Method according to claim 12, characterized in that, when the set value of the air temperature serving as a basis for control of the cooling means for continuation of the cooling cycle is calculated at higher than 0° C., the said set value is considered equal to 0° C.

14. Method according to claim 13, characterized in that at the start of the cycle the maximum duration of cooling is readjusted as a function of the real temperature of the product on loading in the cell, upon the first temperature reading, the maximum duration of the predefined cycle being initialized at zero, and the core temperature measured is then compared with the initial core temperature of the predefined cycle.

* * * * *